United States Patent [19]

Fahmueller

[11] Patent Number: 4,722,118

[45] Date of Patent: Feb. 2, 1988

[54] DEVICE TO DRAW OFF CARD WEB

[75] Inventor: Maximilian Fahmueller, Ingolstadt, Fed. Rep. of Germany

[73] Assignee: Schubert & Salzer Maschinenfabrik Aktiengesellschaft, Ingolstadt, Fed. Rep. of Germany

[21] Appl. No.: 917,047

[22] Filed: Oct. 9, 1986

[30] Foreign Application Priority Data

Oct. 11, 1985 [DE] Fed. Rep. of Germany ..... 3536333

[51] Int. Cl.[4] ..... D01G 15/46

[52] U.S. Cl. ..... 19/106 R; 19/65 CR

[58] Field of Search ..... 19/65 CC, 106 R

[56] References Cited

U.S. PATENT DOCUMENTS 3,946,464 3/1976 Meinke et al. ..... 19/106 R
4,501,048 2/1985 Varga ..... 19/106 R

FOREIGN PATENT DOCUMENTS 0190837 8/1956 Austria ..... 19/65 CR
0654225 5/1963 Italy ..... 19/65 CR

*Primary Examiner*—Louis K. Rimrodt
*Attorney, Agent, or Firm*—Julian W. Dority

[57] ABSTRACT

A fiber carding web emerging from a pair of crush rollers is taken off and is gathered into a fiber sliver by at least one endless conveyor belt which is guided by means of a first and a second guide roll and is tangent to the pair of rollers across their feeding width. In order to ensure that the carding web is taken off correctly when the relative axial position of the rollers to each other changes, the axis of the guide rolls is supported so that it can be locked in the changed axial position of the rollers and the conveyor belt is guided over a driving roll removed from the plane connecting the axes of the guide rolls.

18 Claims, 5 Drawing Figures

DEVICE TO DRAW OFF CARD WEB

The instant invention concerns a device to draw off a fiber carding web emerging from a pair of rollers and to gather it into a fiber sliver by means of at least one endless conveyor belt guided by means of first and second guide rolls, said conveyor belt being disposed at a tangent to the pair of rollers across their feeding width.

A known method consists in drawing off a fiber carding web emerging from a pair of feeding rollers by means of a conveyor belt which is tangent to the pair of rollers across their entire feeding width and which constitutes a conveying plane crossing the plane of the fiber carding web and to gather same into a fiber sliver as seen in German published Patent Application No. OS 1.912.452.

Instead of only one conveyor belt, it is also possible to utilize at least two conveyor belts, running against each other, tangent to the pair of feeding rollers, whereby each conveyor belt can also be guided over a third guide roll in such a manner that the two conveyor belts run essentially parallel to each other in the conveying direction of the fiber sliver and guide said fiber sliver up to the proximity of a pair of draw-off rollers.

In carding units, the pair of feeding rollers are often two cylindrical crush rollers which crush leaf and husk particles still remaining in the fiber carding web. In order to distribute the pressure exerted upon the upper roller of the pair of crush rollers evenly across their working widths, and to ensure that the fibers are treated with care, a cross-shifting of the roller axes takes place, the extent of said cross-shifting depending upon the type of fiber material being processed and upon the desired force of the pressure as seen in German Patent No. PS 1.510.215. However, taking the rollers out of their parallel axial positions has, as a consequence, in the known device, that the conveyor belt loses its tangential contact with the rollers across their feeding width. This interferes with the drawing off and gathering of the fiber carding web emerging from the pair of rollers.

SUMMARY OF THE INVENTION

It is the object of the instant invention to avoid this disadvantage and to ensure proper drawing off and gathering of the fiber carding web, even when the relative axial position of the rollers in relation to each other changes.

This object is attained with a device according to the invention in that the axis of the guide rolls is supported so that it can be locked in the changed relative axial position of the rollers and the conveyor belt is guided over a driving roll removed from the plane connecting the axes of the guide rolls.

The conveyor belt arriving at the rollers can thereby be brought into a position by means of the guide rolls in which it no longer lies on one plane but is cross-shifted in such manner as to contact the two rollers tangentially across their feeding widths, following an axial shift.

In an advantageous further embodiment of the invention the guide rolls are supported on a swivel pin. Provisions are made for the center of gravity of the swivel pin to be at the level of the central axis of one of the two rollers of the pair of rollers, so that the axial position of one of the rollers can be changed and the position of the conveyor belt can be adapted to it. In order to make it possible to adjust and correct the positon of the conveyor belt in relation to the guide rolls, the swivel pin is installed rotatably in a bearing plate which can be pivoted around a shaft which is perpendicular to the longitudinal axis of the rollter. Tightening of the conveyor belt is made possible by the fact that the shaft is installed in a support plate capable of sliding in the direction of the longitudinal axis of the rollers. Due to the fact that the driving rolls of the conveyor belts are in one and the same driving plane when two conveyor belts are used, the driving function is simplified. The arrangement of the driving rolls directly next to each other ensures that the conveyor belts, which are guides so as to run parallel to each other in the conveying direction, guide the fiber sliver. Access to the fiber sliver being fed between the conveyor belts is facilitated if the driving roll of each conveyor belt is at a location removed from the path of movement of the fiber sliver. The pair of rollers becomes freely accessible due to the fact that the conveyor belts, together with their guide and driving rolls, can be moved away from the two rollers.

BRIEF DESCRIPTION OF THE DRAWINGS

The invention will now be described in further detail, with reference to the accompanying drawings in which.

DETAILED DESCRIPTION OF THE INVENTION

Figure 4:
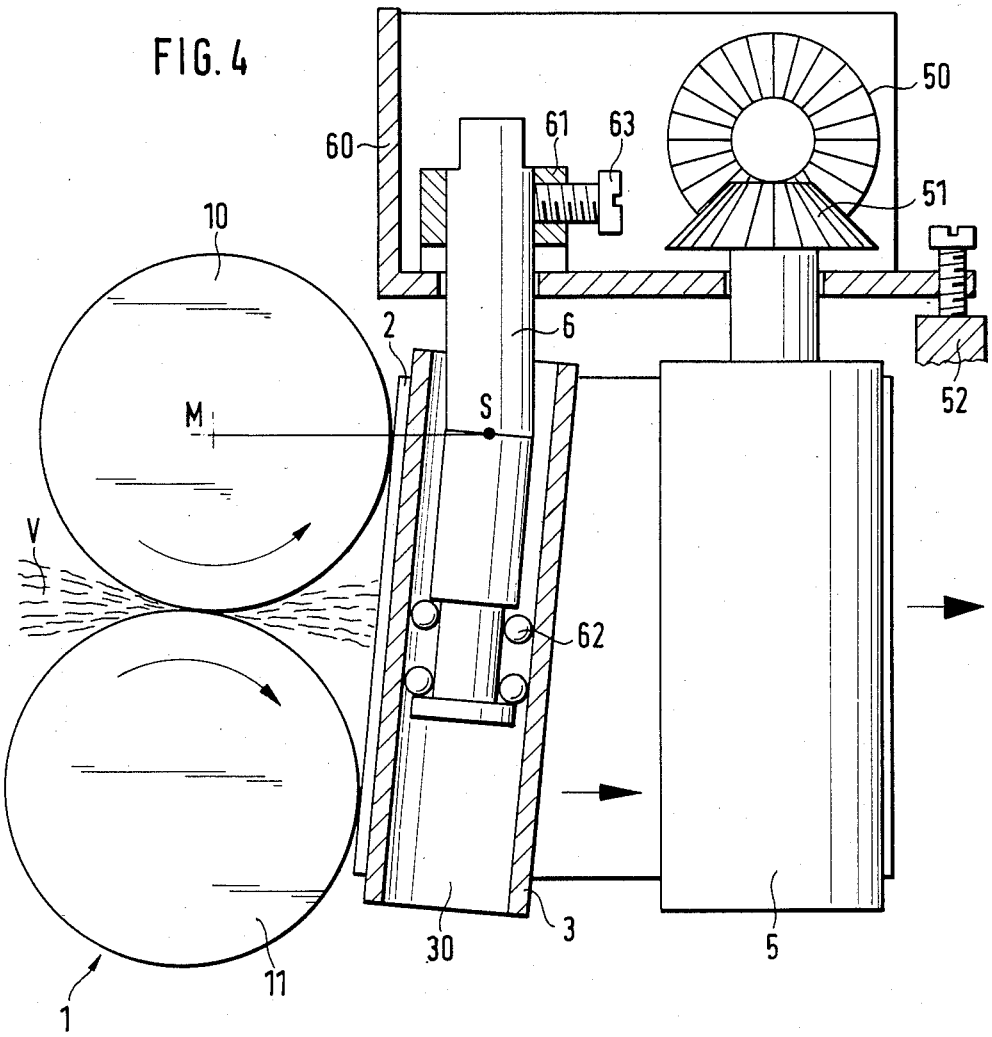
FIG. 4 is a diagrammatic enlarged side elevation of the swivel support for the guide rollers, with some parts shown in section.

A pair of crush rollers 1 with an upper roller 10 and a lower roller 11 is shown in FIG. 4, with an endless conveyor belt 2 installed at their feeding side. The conveyor belt 2 is led over a first guide roll 3 and a second guide roll 4 in such manner that the upper roller 10 and the lower roller 11 of the pair of crush rollers are contacted tangentially by said conveyor belt. Removed from the axes connecting plane A of the guide rolls 3 and 4, a driving roll 5 is provided, which is driven by a drive shaft 50 by a bevel gear 51, and drives the conveyor belt 2 in the direction of arrow P. In certain cases however, the conveyor belt 2 can also be driven in the opposite direction.

The guide rolls 3 and 4 are supported on bearings in such adjustable manner that their axes can be locked to the changed relative axial position of rollers 10 and 11 to each other. The shift is preferably affected by means of a swivel pin 6, on which the guide pulley 3 and, in an analogous manner, guide roll 4 are supported on bearings (FIG. 4). The swivel pin 6 is pivotably installed on a machine part 60 in a bearing plate 61 and extends into a bore 30 of the guide roll 3 in which it is supported by means of roller bearings 62. By shifting the swivel pin 6 after loosening a safety screw 63, the axial position of the guide rolls 3 and 4, and, thereby, the position of the conveyor belt 3, can be adapted to the axial position of the two rollers 10 and 11. Normally the axis of only one roller is shifted.

Provisions are therefore made for the center of gravity of the swivel pin 6 to be at the level of the central axis of one of the two rollers 10 and 11. In FIG. 4 the center of gravity 5 of the swivel pin 6 is at the level of the central axis M of the upper roller 10, so that when the guide rolls 3 and 4 are correspondinly shifted by means of the swivel pin 6, the conveyor belt 2 can follow an axial shift of the lower roller 11 and can, for example, be brought into the slanted position shown in the illustration of FIG. 4, in which it again comes into tangential contact with the two rollers of the pair of crush rollers 1.

If the axial position of only the upper roller 10 is to be changed, or if a cross-shifting of the axes of both rollers is to take place, the center of gravity of the swivel pin 6 is located at the level of the central axis of the lower roller 11 in the first case, and at the level of the nip line between rollers 10 and 11 in the second case.

Figure 5:
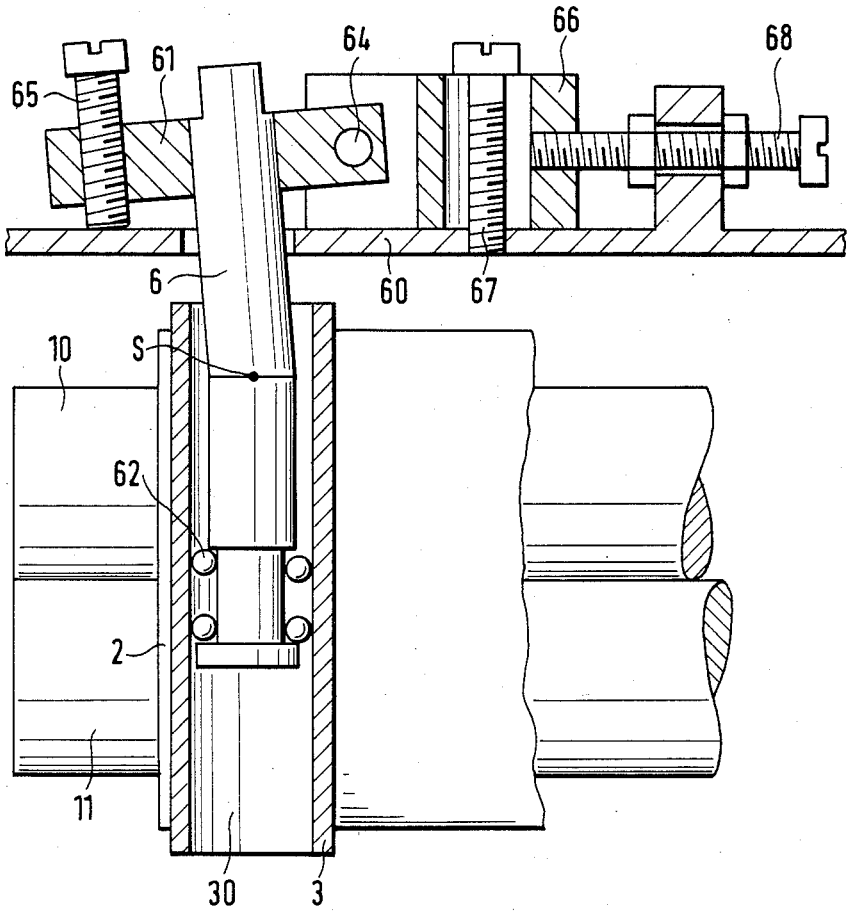
FIG. 5 is an enlarged front elevation showing the swivel support for the guide roller, with some parts in section.

In order to prevent the conveyor belt 2 from running off the guide rolls after a change in axial position of the guide rolls 3 and 4, the bearing plate 61, in which the swivel pin 6 is installed, is pivotably supported around a shaft 64 provided at a perpendicular to the longitudinal axis of rollers 10 and 11 (FIG. 5). By rotating an adjusting screw 65 screwed into the bearing plate 61 and bearing against machine part 60, the swivel pin 6 can be shifted, together with the guide roller and a line with the rollers 10, 11, and the running path of conveyor belt 1 can thus be corrected.

Shaft 64 is installed in a bearing plate 66 which is attached to machine part 60 by means of a screw 67. Upon loosening of screw 67, the bearing plate 66 can be shifted in the direction of the longitudinal axis of the rollers 10, 11 by means of an adjusting screw 68, this causing the conveyor belt 2 to be tightened by the guide roll 3.

Figure 1:
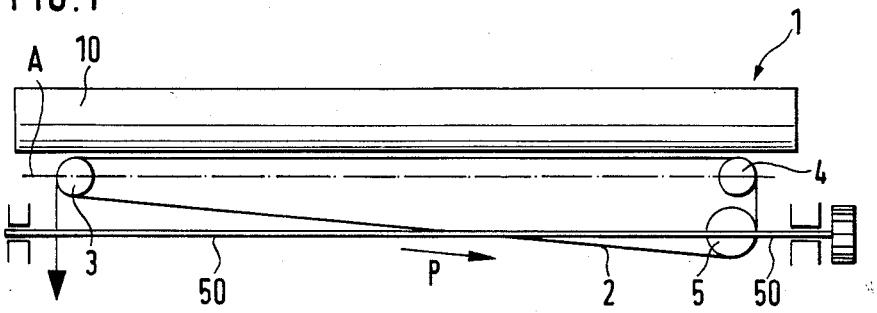
FIG. 1 is a diagrammatic top plan view of the invention utilizing a single conveyor belt and a pair of crush rollers.
Figure 2:
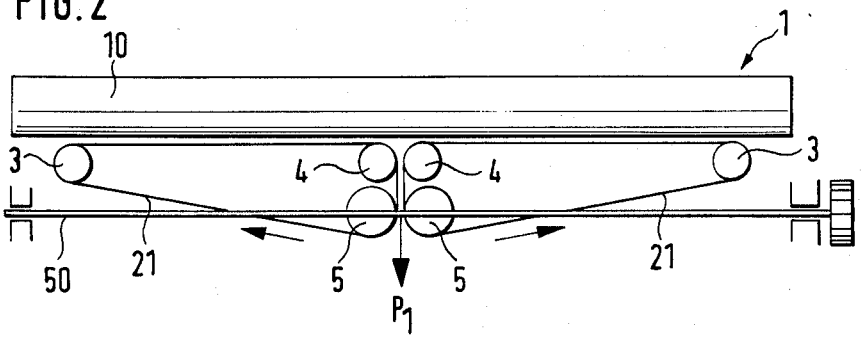
FIG. 2 is a diagrammatic top plan view of another embodiment of the invention wherein two conveyor belts and a pair of crush rollers are shown.

In FIG. 2, two conveyor belts 21, each of which is guided over the first guide roll 3 and over the secnd guide roll 4 and is driven by driving roll 5 are adapted to the pair of crush roller 1. The two conveyor belts 21 are driven in opposite directions. The driving rolls 5 are removed from the axial connection plant A of the guide rolls 3 and 4 and are located directly next to each other, so that the fiber sliver is guided in the conveying direction P1, by the conveyor belt running next to each other and parallel to each other. Driving rolls 5 are furthermore located in the same drive plane and are driven together via drive shaft 50.

Figure 3:
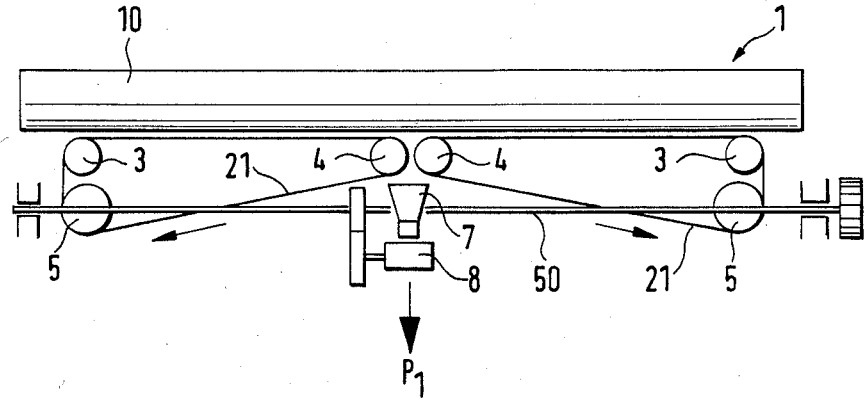
FIG. 3 is a diagrammatic top plan view of a third embodiment of the invention showing two conveyor belts and a pair of crush rollers.

The embodiment illustrated in FIG. 3 differs from the one in FIG. 2 in that the driving rolls 5 are located at a distance from the conveying path of the fiber sliver designated by the arrow P1, so that access to the outlet of the fiber sliver is made possible. The fiber sliver emerging between the guide rolls 4 is sucked into a sliver trumpet 7, which constitutes an injector, and is drawn off by a pair of draw-off rollers 8. Here too, the driving rolls 5 are located in one, and the same, drive plane and are both driven by drive shaft 50. Drive shaft 50 also drives the pair of draw-off rollers 8.

It is a feature common to all of the embodiments shown as examples, that the conveyor belt 2, or conveyor betls 21, together with the guide rolls 3 and 4 and the driving roll 5 can be pivoted forward, away from the pair of crush rollers 1. The pivoting movement takes place around drive shaft 50 of the drive pulley(s) 5 and is limited by stops 52. If necessary, the device can also be made to slide, in some embodiments, so as to afford access to the pair of crush rollers 1.

What is claimed is:

1. An apparatus for taking off a fiber carding web from a pair of crush rollers, the longitudinal axis of said crush rollers extending in spaced horizontal planes, and for gathering said web into a fiber sliver, comprising:

(a) a first guide roll whose longitudinal axis is generally transverse to the longitudinal axes of said crush rollers;

(b) a second guide roll whose longitudinal axis is generally transverse to the longitudinal axes of said crush rollers;

(c) a drive roll;

(d) an endless conveyor guided about said guide rolls and said drive roll, and in tangential contact with both of said crush rollers;

(e) support means for each of the guide rolls, which permits the longitudinal axis of each of said guided rolls to be adjusted to maintain said conveyor belt in tangential contact with both of said crush rollers; and (f) support means for said drive roll, which is removed from a plane taken along the longitudinal axis of said guide rolls.

2. An apparatus for taking off a carding web as set forth in claim 1, wherein the guide rolls are supported on a swivel pin.

3. An apparatus for taking off a fiber carding web as set forth in claim 2, wherein the center of gravity of the swivel pin is located at the level of the central axis of one of said crush rollers.

4. An apparatus for taking off a fiber carding web as set forth in claim 2, wherein the swivel pin is rotatably installed in a bearing plate, which plate is pivotable about a shfat which is perpendicular to the longitudinal axes of the crush rollers.

5. An apparatus for taking off a fiber carding web as set forth in claim 4, wherein said perpendicular shaft is disposed in a bearing plate, which plate is slidable in the direction of the longitudinal axes of the crush rollers.

6. An apparatus for taking off a fiber carding web as set forth in claim 1, wherein two conveyor belts are guided in tangential contact with said crush rollers by two sets of guide rolls and drive rolls and the longitudinal axis of said drive rolls are located in the same driving plane.

7. An apparatus for taking off a fiber carding web as set forth in claim 6, wherein said drive rolls are disposed adjacent to each other.

8. An apparatus for taking off a fiber carding web as set forth in claim 6, wherein the drive roll for each conveyor belt is disposed at a distance from the path of the fiber sliver.

9. An apparatus for taking off a fiber carding web as set forth in claim 1, wherein the conveyor belt and its supporting rolls can be moved away from said crush rollers.

10. In a carding device having a pair of crush rollers whose longitudinal axes are not parallel, an apparatus for taking off a fiber carding web from said crush rollers and to gather said web into a fiber sliver, comprising:

(a) a first guide roll whose longitudinal axis is generally tranverse to the longitudinal axes of said crush rollers;

(b) a second guide roll whose longitudinal axis is generally transverse to the longitudinal axes of said crush rollers;

(c) a drive roll;

(d) an endless conveyor guided about said guide rolls and said drive roll, and in tangential contact with both of said crush rollers;

(e) support means for each of the guide rolls, which permits the longitudinal axis of each of said guide rolls to be independently adjusted to maintain said conveyor belt in tangential contact with both of said crush rollers; and (f) support means for said drive roll, which is removed from the planes in which the longitudinal axes of said guide rolls extend.

11. In a carding device as set forth in claim 10, wherein each of said guide rolls are supported on a swivel pin.

12. In a carding device as set forth in claim 11, wherein the center of gravity of each of the swivel pins is located at the lvel of the central axis of one of said crush rollers.

13. In a carding device as set forth in claim 11, wherein each of the swivel pins is rotatably installed in a bearing plate, which plate is pivotable about a shaft which is perpendicular to the longitudinal axes of the crush rollers.

14. In a carding device as set forth in claim 13, wherein each of said perpendicular shafts is disposed in a bearing plate, which plate is slidable in the direction of the longitudinal axes of the crush rollers.

15. In a carding device as set forth in claim 10, wherein two conveyor belts are guides in tangential contact with said crush rollers by two sets of guide rolls and drive rolls and the longitudinal axes of said drive rolls are located in the same driving plane.

16. In a carding device as set forth in claim 15, wherein said drive rolls are disposed adjacent to each other.

17. In a carding device as set forth in claim 15, wherein the drive roll for each of said conveyor belts is disposed at a distance from the path of the fiber sliver.

18. In a carding device as set forth in claim 10, wherein the conveyor belt and its supporting rolls can be moved away from said crush rollers.

* * * * *